United States Patent [19]

Stoia et al.

[11] 4,019,445

[45] Apr. 26, 1977

[54] STUDDED HEARTH

[75] Inventors: John Z. Stoia, Lewiston; Clarence E. Wright, Tonawanda, both of N.Y.

[73] Assignee: The Carborundum Company, Niagara Falls, N.Y.

[22] Filed: Oct. 8, 1975

[21] Appl. No.: 620,893

[52] U.S. Cl. ..... 110/10; 110/1 A; 110/165 R

[51] Int. Cl.[2] ..... F23G 5/00; F23J 1/00

[58] Field of Search ..... 110/8 R, 10, 165 R, 110/1 A; 122/6 A, 7 A, 235 N, 367 C

[56] References Cited

UNITED STATES PATENTS

| | | | |
|---|---|---|---|
| 1,569,197 | 1/1926 | MacCallum | 110/1 A |
| 3,139,866 | 7/1964 | Lum et al. | 122/6 A |
| 3,212,476 | 10/1965 | Markow et al. | 122/7 A |
| 3,304,918 | 2/1967 | Lewis et al. | 122/367 C |
| 3,741,136 | 6/1973 | Stookey | 122/235 N |

*Primary Examiner*—Kenneth W. Sprague
*Attorney, Agent, or Firm*—David E. Dougherty; William H. Holt

[57] ABSTRACT

A furnace, particularly for use in a slagging pyrolysis system for the disposal of solid waste, includes a metal hearth portion, unprotected by refractory material, the hearth portion having a plurality of heat conducting studs affixed to the inner wall of the hearth portion and means for cooling the studs for causing a slag coating which protects the hearth wall from attack by corrosive substances, minimizes additional heat loss and prevents melting of the hearth wall.

6 Claims, 2 Drawing Figures

STUDDED HEARTH

BACKGROUND OF THE INVENTION

Vertical shaft furnaces of similar construction are disclosed in U.S. Pat. Nos. 3,511,194 and 3,630,508. As disclosed in these two patents, vertical shaft furnaces have heretofore been protected by refractory materials in the hearth portion and at least partially up the vertical shaft portion.

SUMMARY OF THE INVENTION

According to the present invention, there is provided a furnace including a hearth portion defined by a wall, a plurality of protrusions formed of heat conductive material extending into said hearth portion from said wall, and cooling means for cooling said protrusions.

Prior art furnaces, as exemplified by the previously-mentioned two patents, include refractory liners for minimizing heat loss and protecting the hearth wall against melting. Such refractory linings are not completely satisfactory in furnaces which are part of a slagging pyrolysis system for the disposal of municipal solid waste. It has been found that the constituents making up such solid waste causes the refractory material to be attacked by corrosive substances which are alternately acidic and basic. While various refractory materials will withstand attack by acidic material, or basic material, most refractory materials do not withstand attack from both acidic and basic corrosive substances.

The present invention relates, more particularly, to the provision of a plurality of protrusions which are comprised of a series of studs attached to the hot side of the hearth wall by welding or the like. A coolant reservoir is provided for directing water or the like from the reservoir into contact with the cool side of the wall making up the hearth portion such that molten slag within the hearth portion solidifies about the studs, and is supported by the studs, to provide a congealed slag coating which protects the hearth wall from corrosive attack, reduces further heat loss from the hearth and protects the hearth wall from melting under the intense heat within the hearth.

REFERENCE TO THE DRAWING

DETAILED DESCRIPTION OF THE INVENTION

Figure 1:
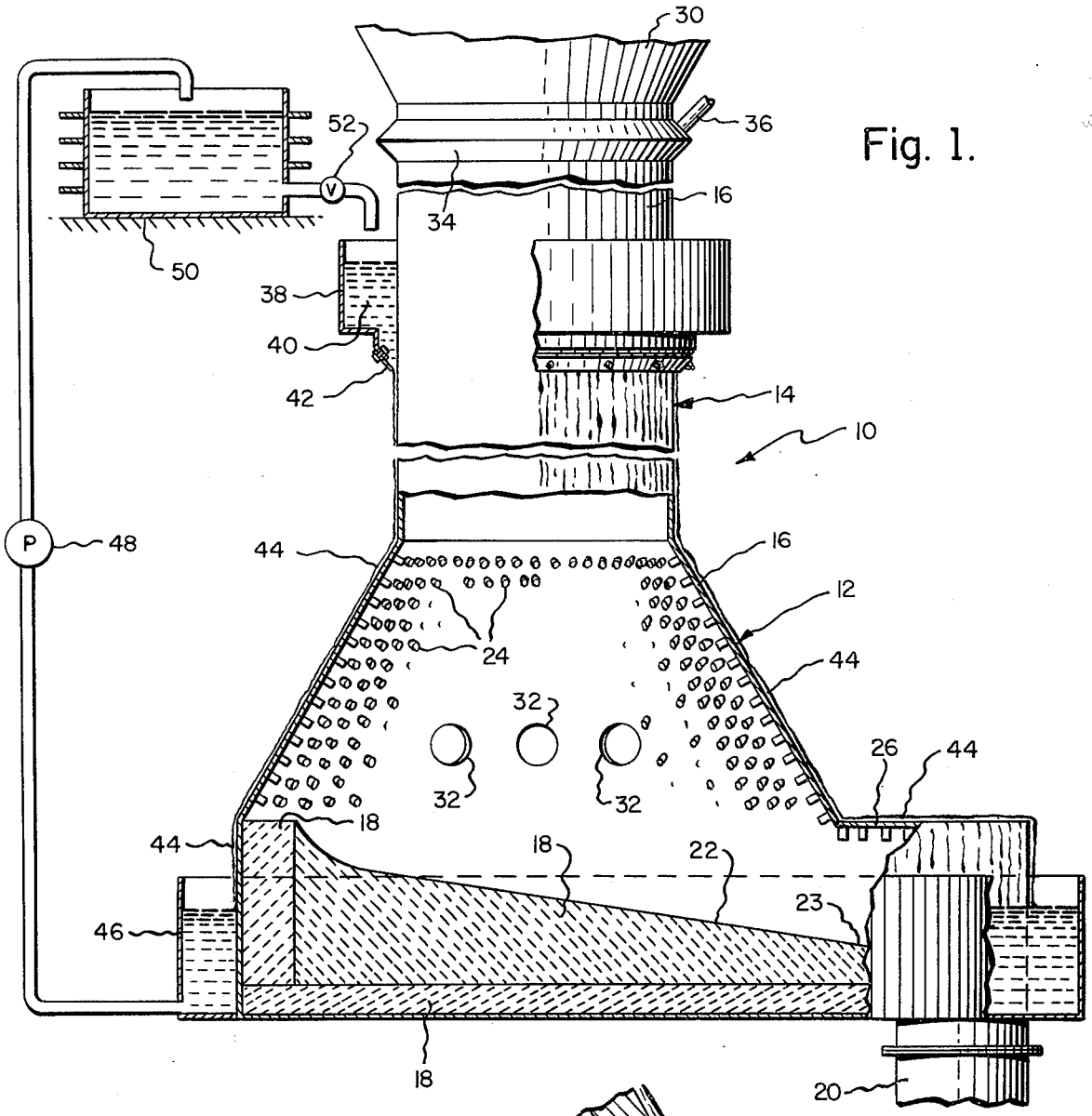
FIG. 1 is a fragmentary elevation view, partly in section and partly diagrammatic, of a vertical shaft furnace and cooling system comprising the present invention.

Shown in FIG. 1 is a furnace, generally indicated by the numeral 10, which includes a hearth portion 12 and a vertical column 14 both of which may be formed of metal walls 16 formed of alloy steel, stainless steel or the like.

The bottom portion of the furnace 10 may be constructed of suitable types of refractory material 18, the types of refractory being chosen in accordance with the particular function of the furnace 10. A discharge conduit 20 is provided at one end of the furnace 10 for permitting molten material to exit from the hearth portion 12 by running down the inclined refractory surface 22 and flowing over a lip 23. Lip 23 may be cooled in a manner fully disclosed in U.S. Pat. No. 3,741,136.

A particularly important part of the invention is the provision of a large number of short, heat conductive studs 24 throughout the total area of the hearth portion 12 and an arch portion 26, the latter being located over the discharge conduit 20. The studs 24 may be formed of alloy steel, or stainless steel or the like and be approximately ¾ inch long by ⅜ inch in diameter. While the size, spacing, material or method of attachment may be done in a variety of ways, it is presently contemplated that they be spaced approximately 1½ inches apart and be fixed to the walls 16 by being welded in a manner illustrated by weld nuggets 28 in FIG. 2.

It is to be understood that during operation of the furnace 10 as part of a slagging pyrolysis system for disposing of municipal solid waste, the waste material, which is usually a mixture of organic and inorganic material, is introduced into the vertical column 14 through an open upper end 30 so that the material fills the vertical column 14 in a manner completely disclosed in U.S. Pat. No. 3,511,194. Various types of reactants, such as hot air or fuel, are introduced into the hearth portion 12 through a series of tuyeres 32. In a manner well known, the inorganic portion of the waste material is melted and exits through discharge conduit 20 while the organic portion of the waste material is pyrolyzed and a producer gas is formed which is taken off by means of a gas collection ring 34 and exit pipe 36.

A reservoir 38 encircles verticle column 14 and contains coolant 40, such as water or the like, and may be provided with an adjustable annular ring 42 for creating a falling curtain of water 44 which flows down the outside, or cool side, of walls 16 and it is collected in a moat 46 which at least partially surrounds or encircles the base of hearth portion 12. The water collected by moat 46 may be raised by a pump 48 and introduced into a cooling tower 50 and then reintroduced into the reservoir 38 through a valve 52. Of course, rather than introducing the heated water into the cooling tower, other uses may be made of the heat energy contained therein.

Figure 2:
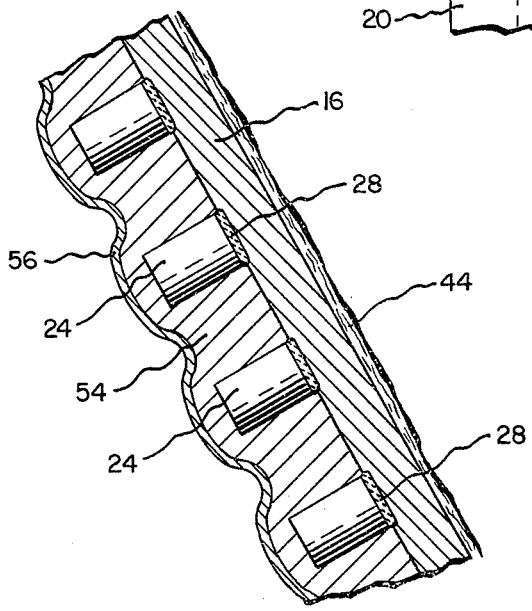
FIG. 2 is an enlarged fragmentary sectional view of the hearth portion and illustrates a studded portion of the hearth wall, a flowing curtain of coolant on the cool side of the hearth wall, a congealed slag coating on the hot side of the hearth wall, and a flowing curtain of molten slag on the congealed slag coating.

The desirable results obtained by the present invention are best illustrated in FIG. 2. As is shown, a plurality of studs 24 are attached to the hot side, or inner surface, of the wall 16 by the weld nuggest 28. It is to be understood that other modes of attachment may be used, e.g., the studs 24 may be attached by screw threads, or the wall 16 may be cast integral with the studs, etc. During operation of the furnce, particularly during a slagging pyrolysis operation for reducing municipal solid wastes, the water curtain 44 cools the wall 16 and studs 24 sufficiently to cause a solidified slag layer 54 to form thereon, thus protecting the studs 24 and wall 16 from corrosive substances, minimize further heat losses and protect the studs and wall against melting. As a result of the formation of slag layer 54, a curtain of molten slag 56 will flow down the hearth portion 12, past lip 23 and exit through discharge conduit 20. Because of temperature changes and the like, it is possible that portions of the slag layer 54 will at times break away from wall 16; in such an event, the slag layer 54 is self-healing and a new layer will be automatically formed thus minimizing or eliminating the need for maintenance of the hearth portion 12.

While the foregoing description sets forth the best mode contemplated by the inventors for carrying out the invention, it is to be understood that various changes and modifications may be made therein without departing from the spirit and scope of the invention as defined in the following claimed subject matter.

We claim:

1. A slagging pyrolysis furnace including a hearth defined by a metal wall having one side thereof facing said hearth, a plurality of protrusions affixed directly to said one side of said wall and freely extending in spaced relation into said hearth without any refractory material being interposed therebetween, and cooling means comprised of means for passing fluid along said wall on the side thereof facing away from said hearth for cooling said wall and said protrusions and for solidifying a layer of slag to coat and protect said protrusions and said one side of said wall.

2. A furnace as defined in claim 1, said furnace further including a vertical column disposed above said hearth for receiving a mixture of organic and inorganic material, and a plurality of tuyeres for introducing reactants into said hearth for thermochemically reacting with said organic and inorganic material.

3. A furnace as defined in claim 1 wherein said furnace includes a vertical column disposed above said hearth for receiving and containing therein material to be pyrolized, said cooling means comprising a coolant reservoir and means for directing coolant from said reservoir into contact with at least a portion of said vertical column and said hearth.

4. A furnace as defined in claim 1, wherein said plurality of protrusions are comprised of a series of metal studs, and said studs are welded to said one side of said wall.

5. In a furnace of the type including a hearth, a discharge conduit for tapping molten material from said hearth, and an arch portion having a hot side thereof, said arch portion being located between said hearth and said discharge conduit, the improvement characterized by a plurality of heat conductive protrusions being provided on said hot side for removing heat from said arch portion for creating and supporting a solidified coating of said molten material on said arch portion.

6. A furnace forming part of a slagging pyrolysis system, said furnace including a hearth portion defined by a wall, a plurality of protrusions formed of heat conductive material extending into said hearth portion from said wall, cooling means for cooling said protrusions, said cooling means comprising means for creating a flowing curtain of water along the exterior of said hearth portion for solidifying a layer of slag about said protrusions to coat and protect the inside surface of said wall of said hearth portion, and a moat, said moat being located to at least partially surround said hearth portion for collecting the water from said flowing curtain of water.

* * * * *